US011120767B2

(12) United States Patent
Wang et al.

(10) Patent No.: US 11,120,767 B2
(45) Date of Patent: Sep. 14, 2021

(54) SOURCE DRIVING CIRCUIT AND METHOD FOR DRIVING THE SAME, AND DISPLAY APPARATUS

(71) Applicants: Ordos Yuansheng Optoelectronics Co., Ltd., Inner Mongolia (CN); BOE Technology Group Co., Ltd., Beijing (CN)

(72) Inventors: Jiguo Wang, Beijing (CN); Jun Fan, Beijing (CN)

(73) Assignees: ORDOS YUANSHENG OPTOELECTRONICS CO., LTD., Inner Mongolia (CN); BOE TECHNOLOGY GROUP CO., LTD., Beijing (CN)

( * ) Notice: Subject to any disclaimer, the term of this patent is extended or adjusted under 35 U.S.C. 154(b) by 4 days.

(21) Appl. No.: 16/611,754

(22) PCT Filed: Oct. 22, 2018

(86) PCT No.: PCT/CN2018/111213
§ 371 (c)(1),
(2) Date: Nov. 7, 2019

(87) PCT Pub. No.: WO2019/200864
PCT Pub. Date: Oct. 24, 2019

(65) Prior Publication Data

US 2020/0066228 A1 Feb. 27, 2020

(30) Foreign Application Priority Data

Apr. 20, 2018 (CN) ..... 201810362677.8

(51) Int. Cl.
*G09G 5/00* (2006.01)

(52) U.S. Cl.
CPC ..... *G09G 5/006* (2013.01); *G09G 2310/0275* (2013.01); *G09G 2310/0286* (2013.01)

(58) Field of Classification Search
CPC ... G09G 2310/0275; G09G 2310/0286; G09G 2310/0267; G09G 3/20; G09G 3/3688;
(Continued)

(56) References Cited

U.S. PATENT DOCUMENTS 4,963,860 A * 10/1990 Stewart ..... G09G 3/3688 345/206
7,196,308 B2 3/2007 Okutani
(Continued)

FOREIGN PATENT DOCUMENTS

CN 1482507 A 3/2004
CN 1940645 A 4/2007
(Continued)

OTHER PUBLICATIONS

First Examination Report under sections 12 and 13 for corresponding Indian Application No. 201947052563, dated Mar. 12, 2021, 6 pages.
(Continued)

*Primary Examiner* — Ryan A Lubit

(57) ABSTRACT

The present disclosure provides a source driving circuit and a method for driving the same, and a display apparatus. The source driving circuit includes: an input sub-circuit, a first latch sub-circuit, a transmission sub-circuit, and a second latch sub-circuit, wherein the first latch sub-circuit has a first reset sub-circuit disposed therein, wherein the first reset sub-circuit is configured to receive a first reset control signal and reset the first latch sub-circuit according to the first reset control signal; and/or the second latch sub-circuit has a second reset sub-circuit disposed therein, wherein the second reset sub-circuit is configured to receive a second reset
(Continued)

control signal and reset the second latch sub-circuit according to the second reset control signal.

11 Claims, 11 Drawing Sheets

(58) Field of Classification Search
CPC .. G09G 3/3677; G09G 3/3266; G09G 3/3674; G09G 3/2092; G09G 2320/0257; G11C 19/28; G11C 19/287
See application file for complete search history.

(56) References Cited

U.S. PATENT DOCUMENTS

| | | | | |
|---|---|---|---|---|
| 7,920,115 | B2 | 4/2011 | Park | |
| 10,311,819 | B2 | 6/2019 | Yi | |
| 2004/0017344 | A1 | 1/2004 | Takemoto | |
| 2007/0070011 | A1 | 3/2007 | Tang | |
| 2007/0070750 | A1* | 3/2007 | Park | G09G 3/3688 365/205 |
| 2010/0128009 | A1* | 5/2010 | Okada | G09G 3/3655 345/205 |
| 2011/0007040 | A1* | 1/2011 | John | G09G 3/20 345/204 |
| 2011/0199353 | A1* | 8/2011 | Chung | G11C 19/28 345/208 |
| 2014/0225817 | A1* | 8/2014 | Huang | G09G 3/3677 345/87 |
| 2017/0169780 | A1* | 6/2017 | Zhao | G09G 3/3677 |
| 2018/0034462 | A1* | 2/2018 | Zhao | H03K 17/6872 |
| 2018/0061348 | A1* | 3/2018 | Zhao | G11C 19/28 |
| 2018/0240432 | A1* | 8/2018 | Zhao | G09G 3/3677 |
| 2018/0301102 | A1* | 10/2018 | Yi | G09G 3/3696 |
| 2019/0206504 | A1* | 7/2019 | Tao | G09G 3/3266 |
| 2020/0066228 | A1 | 2/2020 | Wang et al. | |
| 2020/0111399 | A1 | 4/2020 | Wang et al. | |

FOREIGN PATENT DOCUMENTS

| | | | |
|---|---|---|---|
| CN | 106548758 | A | 3/2017 |
| CN | 107180619 | A | 9/2017 |
| CN | 107633817 | A | 1/2018 |
| CN | 107657927 | A | 2/2018 |
| CN | 108520725 | A | 9/2018 |
| TW | 200713176 | A | 4/2007 |

OTHER PUBLICATIONS

International Search Report and Written Opinion issued in corresponding International Application No. PCTCN2018/099229, dated Nov. 2, 2018, 16 pages, with English translation.
Non-Final Rejection, for co pending U.S. Appl. No. 16/617,127, dated Sep. 25, 2020, 24 pages.

* cited by examiner

SOURCE DRIVING CIRCUIT AND METHOD FOR DRIVING THE SAME, AND DISPLAY APPARATUS

CROSS-REFERENCE TO RELATED APPLICATION(S)

This application is a Section 371 National Stage application of International Application No. PCT/CN2018/111213, filed on 22 Oct. 2018, which published as WO 2019/200864 A1 on 24 Oct. 2019, and claims priority to the Chinese Patent Application No. 201810362677.8, filed on Apr. 20, 2018, the contents of which are incorporated herein by reference.

TECHNICAL FIELD

The present disclosure relates to the field of displays, and more particularly, to a source driving circuit and a method for driving the same, and a display apparatus.

BACKGROUND

A display driving circuit of a display device comprises a source driver, a gate driver, and a Timing Controller (TCON). The source driver converts a received data signal into a source driving signal and output the source driving signal to a display panel of the display device under control of the timing controller.

SUMMARY

Embodiments of the present disclosure provide a source driving circuit and a method for driving the same, and a display apparatus, which may alleviate a problem of race hazard of the source driving circuit during data transmission performed by the source driving circuit.

According to an aspect of the embodiments of the present disclosure, there is provided a source driving circuit, comprising:

an input sub-circuit configured to receive a data signal, a first control signal, and a second control signal, and provide the received data signal to an output terminal of the input sub-circuit according to the first control signal and the second control signal;

a first latch sub-circuit connected to the output terminal of the input sub-circuit, the first latch sub-circuit is configured to receive the first control signal and the second control signal, latch the data signal provided from the output terminal of the input sub-circuit according to the first control signal and the second control signal, and provide the latched data signal to an output terminal of the first latch sub-circuit;

a transmission sub-circuit connected to the output terminal of the first latch sub-circuit, the transmission sub-circuit is configured to receive a third control signal and a fourth control signal, and transmit the latched data signal from the output terminal of the first latch sub-circuit to an output terminal of the transmission sub-circuit according to the third control signal and the fourth control signal; and a second latch sub-circuit connected to the output terminal of the transmission sub-circuit, the second latch sub-circuit is configured to receive the third control signal and the fourth control signal, and latch the data signal from the output terminal of the transmission sub-circuit according to the third control signal and the fourth control signal, wherein, the first latch sub-circuit has a first reset sub-circuit disposed therein, wherein the first reset sub-circuit is configured to receive a first reset control signal and reset the first latch sub-circuit according to the first reset control signal; and/or the second latch sub-circuit has a second reset sub-circuit disposed therein, wherein the second reset sub-circuit is configured to receive a second reset control signal and reset the second latch sub-circuit according to the second reset control signal.

In an example, the transmission sub-circuit comprises:

a fifth inverter having an input terminal and an output terminal, wherein the input terminal of the fifth inverter is configured to receive the data signal from the first latch sub-circuit; and a third transmission gate having an input terminal connected to the output terminal of the fifth inverter, a first control terminal configured to receive the fourth control signal, a second control terminal configured to receive the third control signal, and an output terminal connected to the second latch sub-circuit, wherein the third transmission gate is configured to be turned on or turned off according to the third control signal and the fourth control signal.

In an example, the second latch sub-circuit has the second reset sub-circuit disposed therein, wherein the second latch sub-circuit comprises:

a first transmission gate having an input terminal, a first control terminal, a second control terminal, and an output terminal, and configured to be turned on or turned off according to the third control signal and the fourth control signal, wherein the first control terminal of the first transmission gate is configured to receive the third control signal, the second control terminal of the first transmission gate is configured to receive the fourth control signal, and the output terminal of the first transmission gate is configured to receive the data signal from the transmission sub-circuit;

the second reset sub-circuit comprising a first NAND gate having a first input terminal configured to receive the second reset control signal, a second input terminal connected to the output terminal of the first transmission gate, and an output terminal acting as the output terminal of the second latch sub-circuit; and a second inverter having an input terminal and an output terminal, wherein the input terminal of the second inverter is connected to the output terminal of the first NAND gate, and the output terminal of the second inverter is connected to the input terminal of the first transmission gate.

In an example, the first latch sub-circuit has the first reset sub-circuit disposed therein, wherein the first latch sub-circuit comprises:

a second transmission gate having an input terminal, a first control terminal, a second control terminal, and an output terminal, and configured to be turned on or turned off according to the first control signal and the second control signal, wherein the first control terminal of the second transmission gate is configured to receive the first control signal, the second control terminal of the second transmission gate is configured to receive the second control signal, and the output terminal of the second transmission gate is configured to receive the data signal from the input sub-circuit;

the first reset sub-circuit comprising a second NAND gate having a first input terminal configured to receive the first reset control signal, a second input terminal connected to the output terminal of the second transmission gate, and an output terminal acting as the output terminal of the first latch sub-circuit; and a fourth inverter having an input terminal and an output terminal, wherein the input terminal of the fourth inverter is connected to the output terminal of the second NAND gate, and the output terminal of the fourth inverter is connected to the input terminal of the second transmission gate.

In an example, the first latch sub-circuit has the first reset sub-circuit disposed therein, and the second latch sub-circuit has the second reset sub-circuit disposed therein, wherein the first latch sub-circuit comprises:

a second transmission gate having an input terminal, a first control terminal, a second control terminal, and an output terminal, and configured to be turned on or turned off according to the first control signal and the second control signal, wherein the first control terminal of the second transmission gate is configured to receive the first control signal, the second control terminal of the second transmission gate is configured to receive the second control signal, and the output terminal of the second transmission gate is configured to receive the data signal from the input sub-circuit;

the first reset sub-circuit comprising a second NAND gate having a first input terminal configured to receive the first reset control signal, a second input terminal connected to the output terminal of the second transmission gate, and an output terminal acting as the output terminal of the first latch sub-circuit; and a fourth inverter having an input terminal and an output terminal, wherein the input terminal of the fourth inverter is connected to the output terminal of the second NAND gate, and the output terminal of the fourth inverter is connected to the input terminal of the second transmission gate, and the second latch sub-circuit comprises:

a first transmission gate having an input terminal, a first control terminal, a second control terminal, and an output terminal, and configured to be turned on or turned off according to the third control signal and the fourth control signal, wherein the first control terminal of the first transmission gate is configured to receive the third control signal, the second control terminal of the first transmission gate is configured to receive the fourth control signal, and the output terminal of the first transmission gate is configured to receive the data signal from the transmission sub-circuit;

the second reset sub-circuit comprising a first NAND gate having a first input terminal configured to receive the second reset control signal, a second input terminal connected to the output terminal of the first transmission gate, and an output terminal acting as the output terminal of the second latch sub-circuit; and a second inverter having an input terminal and an output terminal, wherein the input terminal of the second inverter is connected to the output terminal of the first NAND gate, and the output terminal of the second inverter is connected to the input terminal of the first transmission gate.

In an example, the input sub-circuit comprises:

a fourth transmission gate having an input terminal configured to receive the data signal, a first control terminal configured to receive the second control signal, a second control terminal configured to receive the first control signal, and an output terminal configured to output the received data signal, wherein the fourth transmission gate is configured to be turned on or turned off according to the first control signal and the second control signal.

In an example, the source driving circuit further comprises a shaping sub-circuit having a sixth inverter, a seventh inverter, and an eighth inverter, wherein the sixth inverter has an input terminal configured to receive the data signal from the second latch sub-circuit, and an output terminal connected to an input terminal of the seventh inverter, the seventh inverter has an output terminal connected to an input terminal of the eighth inverter, and the eighth inverter has an output terminal acting as an output terminal of the source driving circuit.

According to another aspect of the embodiments of the present disclosure, there is provided a display apparatus, comprising the source driving circuit described above.

According to yet another aspect of the embodiments of the present disclosure, there is provided a method for driving the source driving circuit described above, the method comprising:

in the first phase, providing, by the input sub-circuit, the received data signal to the first latch sub-circuit under control of the first control signal and the second control signal;

in a second phase, latching, by the first latch sub-circuit, the data signal provided by the input sub-circuit under control of the first control signal and the second control signal;

in a third phase, turning on the transmission sub-circuit and turning off the second latch sub-circuit under control of the third control signal and the fourth control signal, so that the transmission sub-circuit transmits the data signal latched by the first latch sub-circuit to the second latch sub-circuit; and in a fourth phase, turning off the transmission sub-circuit and turning on the second latch sub-circuit under control of the third control signal and the fourth control signal, so that the second latch sub-circuit latches the data signal from the transmission sub-circuit.

In an example, the method further comprises: resetting at least one of the first latch sub-circuit and the second latch sub-circuit under control of the reset control signal.

In an example, the method further comprises: shaping the data signal latched by the second latch sub-circuit and outputting the shaped data signal.

BRIEF DESCRIPTION OF THE ACCOMPANYING DRAWINGS

DETAILED DESCRIPTION

The technical solutions according to the embodiments of the present disclosure will be clearly and completely described below with reference to the accompanying drawings in the embodiments of the present disclosure. Obviously, the embodiments described are merely a part of the embodiments of the present disclosure, and should not be construed as the scope of the present disclosure. All other embodiments obtained by those of ordinary skill in the art based on the embodiments of the present disclosure without any creative work shall fall within the protection scope of the present disclosure.

Figure 1:
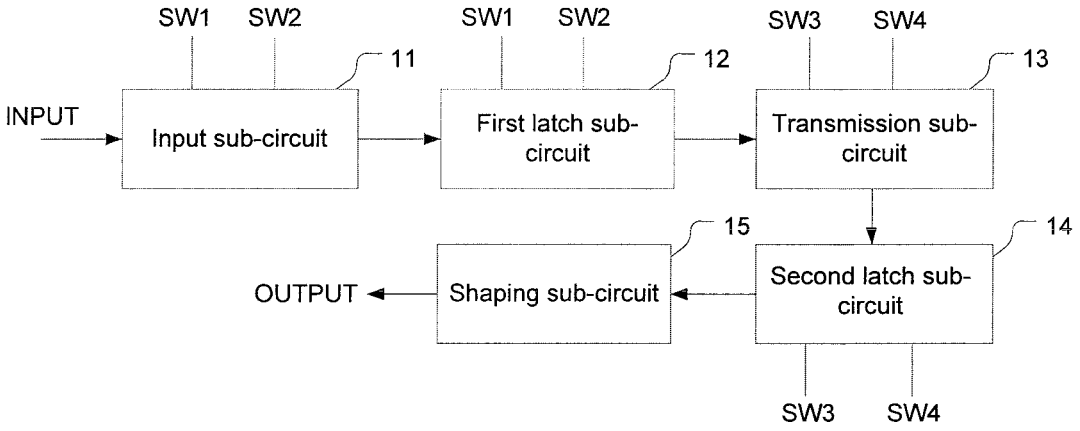
FIG. 1 is a schematic block diagram of a source driving circuit according to an embodiment of the present disclosure.

FIG. 1 is a schematic block diagram of a source driving circuit according to an embodiment of the present disclosure. As shown in FIG. 1, the source driving circuit according to the embodiment of the present disclosure comprises an input sub-circuit 11, a first latch sub-circuit 12, a transmission sub-circuit 13, and a second latch sub-circuit 14.

The input sub-circuit 11 receives a data signal INPUT, a control signal SW1, and a control signal SW2, and provides the received data signal to the first latch sub-circuit 12 to an output terminal of the input sub-circuit 11 according to the control signal SW1 and the control signal SW2.

The first latch sub-circuit 12 is connected to the output terminal of the input sub-circuit 11. The first latch sub-circuit 12 receives the control signal SW1 and the control signal SW2, latches the data signal from the output terminal of the input sub-circuit 11 according to the control signal SW1 and the control signal SW2, and provides the latched data signal to an output terminal of the first latch sub-circuit 12.

The transmission sub-circuit 13 is connected to the output terminal of the first latch sub-circuit 12. The transmission sub-circuit 13 receives a control signal SW3 and a control signal SW4, and transmits the latched data signal from the output terminal of the first latch sub-circuit 12 to the second latch sub-circuit 14 according to the control signal SW3 and the control signal SW4.

The second latch sub-circuit 14 is connected to the output terminal of the transmission sub-circuit 13. The second latch sub-circuit 14 receives the control signal SW3 and the control signal SW4, and latches the data signal from the output terminal of the transmission sub-circuit 13 according to the control signal SW3 and the control signal SW4.

The source driving circuit according to the embodiment of the present disclosure may further comprise a shaping sub-circuit 15. The shaping sub-circuit 15 shapes the data signal output by the second latch sub-circuit 14 and then outputs the shaped data signal as an output signal OUTPUT.

In the present embodiment, the second latch sub-circuit 14 and the transmission sub-circuit 13 are configured to operate alternately. For example, the second latch sub-circuit 14 is turned off when the transmission sub-circuit 13 is turned on, and the second latch sub-circuit 14 is turned on when the transmission sub-circuit 13 is turned off. In this way, the second latch sub-circuit 14 is in an off state during the transmission of the data signal by the transmission sub-circuit 13 to the second latch sub-circuit 14, which avoids race hazard between the first latch sub-circuit 12 and the second latch sub-circuit 14, thereby improving the stability of data transmission.

Figure 2:
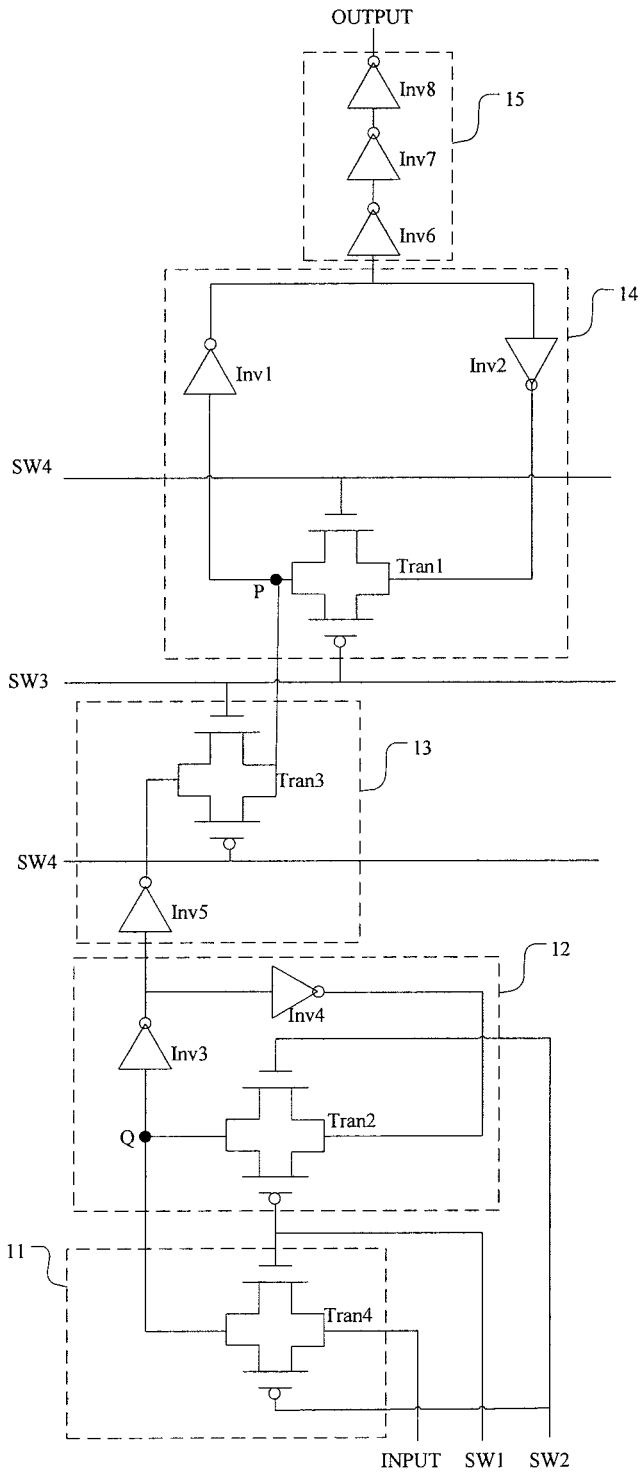
FIG. 2 is an exemplary circuit diagram of the source driving circuit of FIG. 1.

FIG. 2 is an exemplary circuit diagram of the source driving circuit of FIG. 1.

As shown in FIG. 2, the input sub-circuit 11 may comprise a transmission gate Tran4. The transmission gate Tran4 is turned on or turned off according to the control signal SW1 and the control signal SW2. The transmission gate Tran4 has an input terminal, a first control terminal, a second control terminal and an output terminal, wherein the input terminal of the transmission gate Tran4 receives the data signal INPUT, the first control terminal of the transmission gate Tran4 receives the control signal SW2, the second control terminal of the transmission gate Tran4 receives the control signal SW1, and the output terminal of the transmission gate Tran4 outputs the received data signal.

The first latch sub-circuit 12 may comprise a transmission gate Tran2, an inverter Inv3, and an inverter Inv4. The inverter Inv3 and the inverter Inv4 are connected in series between an input terminal and an output terminal of the transmission gate Tran2 to form a loop. The transmission gate Tran2 is turned on or turned off according to the control signal SW1 and the control signal SW2. As shown in FIG. 2, the transmission gate Tran2 has the input terminal, a first control terminal, a second control terminal, and the output terminal, wherein the first control terminal of the transmission gate Tran2 receives the control signal SW1, the second control terminal of the transmission gate Tran2 receives the control signal SW2, and the output terminal of the transmission gate Tran2 is connected to the output terminal of the transmission gate Tran4 in the input sub-circuit 11 to receive the data signal from the input sub-circuit 11. An input terminal of the inverter Inv3 is connected to the output terminal of the transmission gate Tran2, an output terminal of the inverter Inv3 is connected to an input terminal of the inverter Inv4, and an output terminal of the inverter Inv4 is connected to the input terminal of the transmission gate Tran2. In the present embodiment, a node between the output terminal of the transmission gate Tran2 and the output terminal of the transmission gate Tran4 is denoted by Q, and the first latch sub-circuit 12 receives the data signal from the input sub-circuit 11 at the node Q. The output terminal of the inverter Inv3, that is, a node between the inverter Inv3 and the inverter Inv4, is connected as the output terminal of the first latch sub-circuit 12 to the transmission sub-circuit 13 to provide the data signal to the transmission sub-circuit 13.

The transmission sub-circuit 13 may comprise a transmission gate Tran3 and an inverter Inv5 which are connected in series. The third transmission gate Tran3 is turned on or turned off according to the control signal SW3 and the control signal SW4. As shown in FIG. 2, the transmission gate Tran3 has an input terminal, a first control terminal, a second control terminal, and an output terminal, wherein the first control terminal of the transmission gate Tran3 receives the control signal SW4, the second control terminal of the transmission gate Tran3 receives the control signal SW3, and the output terminal of the transmission gate Tran3 is connected to the second latch sub-circuit 14 to transmit the data signal to the second latch sub-circuit 14. The inverter Inv5 has an input terminal connected to the output terminal of the inverter Inv3 in the first latch sub-circuit 12 to receive the data signal from the first latch sub-circuit 12, and an output terminal connected to the input terminal of the transmission gate Tran3.

The second latch sub-circuit 14 may comprise a transmission gate Tran1, an inverter Inv1, and an inverter Inv2. The inverter Inv1 and the inverter Inv2 are connected in series between an input terminal and an output terminal of the transmission gate Tran1 to form a loop. The transmission gate Tran1 is turned on or turned off according to the control signal SW3 and the control signal SW4. As shown in FIG. 2, the transmission gate Tran1 has the input terminal, a first control terminal, a second control terminal, and the output terminal, wherein the first control terminal of the transmission gate Tran1 receives the control signal SW3, the second control terminal of the transmission gate Tran1 receives the control signal SW4, and the output terminal of the transmission gate Tran1 is connected to the output terminal of the transmission gate Tran3 in the transmission sub-circuit 13 to receive the data signal from the transmission sub-circuit 13. An input terminal of the inverter Inv1 is connected to the output terminal of the transmission gate Tran1, an output terminal of the inverter Inv1 is connected to an input terminal of the inverter Inv2, and an output terminal of the inverter Inv2 is connected to the input terminal of the transmission gate Tran1. In the present embodiment, a node between the output terminal of the transmission gate Tran1 and the output terminal of the transmission gate Tran3 is denoted by P, and the second latch sub-circuit 14 receives the data signal from the transmission sub-circuit 13 at the node P. The output terminal of the inverter Inv1, that is, a node between the inverter Inv1 and the inverter Inv2, outputs the data signal as the output terminal of the second latch sub-circuit 14, for example, outputs the data signal to the shaping sub-circuit 15.

The shaping sub-circuit 15 may comprise inverters Inv6, Inv7, and Inv8 which are connected in series. As shown in FIG. 2, an input terminal of the inverter Inv6 is configured to receive the data signal from the second latch sub-circuit 14, an output terminal of the inverter Inv6 is connected to an input terminal of the inverter Inv7, an output terminal of the inverter Inv7 is connected to an input terminal of the inverter Inv8, and an output terminal of the inverter Inv8 provides the output signal OUTPUT as an output terminal of the source driving circuit.

Figure 11:
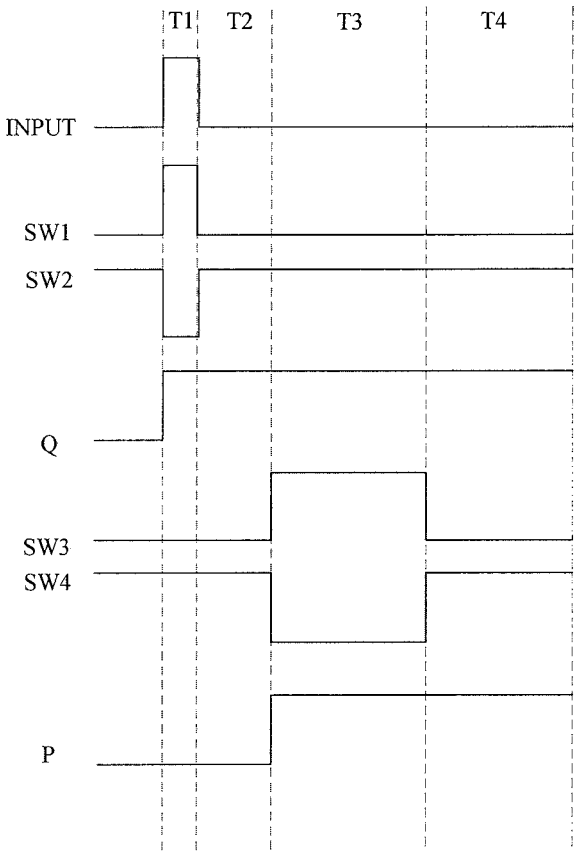
FIG. 11 is an exemplary signal timing diagram of a source driving circuit according to an embodiment of the present disclosure.

An operation manner of the source driving circuit according to an embodiment of the present disclosure will be described below with reference to FIG. 11. FIG. 11 is an exemplary signal timing diagram of a source driving circuit according to an embodiment of the present disclosure. As mentioned in the following description, a first level is a high level, and a second level is a low level. However, the embodiments of the present disclosure are not limited thereto, and in some cases, the first level and the second level may also be a low level and a high level respectively.

In a period T1, the control signal SW1 is at a first level, the control signal SW2 is at a second level, the transmission gate Tran4 is turned on, the transmission gate Tran2 is turned off, the data signal INPUT is written at the node Q, and the node Q changes from a low level to a high level, as shown in FIG. 11. During this period, the control signal SW3 is at the second level, and the control signal SW2 is at the first level, so that the transmission gate Tran3 is turned off, the transmission gate Tran1 is turned on, and the data signal at the node Q is transmitted according to a path Q→Inv3→Inv5, and cannot reach the node P.

In a period T2, the control signal SW1 is at the second level, the control signal SW2 is at the first level, the transmission gate Tran4 is turned off, and the transmission gate Tran2 is turned on, so that the data signal at the node Q is transmitted according to a path Q→Inv3→Inv4→Q to form a loop, and thereby the data signal is latched in the first latch sub-circuit 12. During this period, the control signal SW3 is at the second level, and the control signal SW4 is at the first level, so that the transmission gate Tran3 is turned off, the transmission gate Tran1 is turned on, and the data signal at the node Q still cannot be transmitted to the node P.

In a period T3, the control signal SW1 is at the second level, the control signal SW2 is at the first level, the control signal SW3 is at the first level, and the control signal SW4 is at the second level, so that the transmission gate Tran3 is turned on, and Tran1 is turned off. In this case, the data signal at the node Q is transmitted to the node P according to a path Q→Inv3→Inv5→P, and thereby the data signal is transmitted from the first latch sub-circuit 12 to the second latch sub-circuit 14. At this time, the node P becomes a high level, as shown in FIG. 11. During this period, since the transmission gate Tran1 is in a turn-off state, the transmission gate Tran1 cannot form a loop together with the inverters Inv1 and Inv2. Thereby, transmission of the data signal from the node Q to the node P may not affect the latching of the data signal by the second latch sub-circuit 14.

In a period T4, the control signal SW1 is at the second level, the control signal SW2 is at the first level, the control signal SW3 is at the second level, and the control signal SW4 is at the first level, so that the transmission gate Tran3 is turned off, and the transmission gate Tran1 is turned on. In this case, the transmission path of the data signal from the node Q to the node P is disconnected, the transmission gate Tran1 forms a loop together with the inverters Inv1 and Inv2, the data signal at the node P is transmitted through a path P→Inv1→Inv2→P, and thereby the data signal is latched by the second latch sub-circuit 14. The data signal output by the second latch sub-circuit 14 is provided as the output signal OUTPUT via the three inverters Inv6, Inv7 and Inv8 in the shaping sub-circuit 15.

According to an embodiment of the present disclosure, the control signal SW1 may be a respective output signal of a shift register in the source driving circuit, and the control signal SW2 may be an inverted signal of the control signal SW1. Similarly, the control signal SW3 and the control signal SW4 may be inverted from each other. However, the embodiment of the present disclosure is not limited thereto, and the control signals SW1 to SW4 may be set as needed.

According to an embodiment of the present disclosure, a second one of two stages of latching in the source driving circuit is designed to comprise the second latch sub-circuit 14 and the transmission sub-circuit 13, the second latch sub-circuit 14 is turned off when the transmission sub-circuit 13 is turned on, and the second latch sub-circuit 14 is turned on when the transmission sub-circuit 13 is turned off, so that the transmission of the data signal from the first latch sub-circuit 12 to the second latch sub-circuit 14 may not affect the latching of the data signal by the second latch sub-circuit 14, which avoids the race hazard, thereby improving the stability of the data transmission. In addition, in the embodiment of the present disclosure, a connection relationship between the transmission gate Tran1 and other components is improved, so that the transmission gate Tran1 forms a loop together with the two inverters Inv1 and Inv2 when the transmission gate Tran1 is turned on, which reduces a number of logic devices in the source driving circuit while reducing the race hazard, thereby saving the cost.

According to an embodiment of the present disclosure, at least one of the first latch sub-circuit 12 and the second latch sub-circuit 14 may have a reset sub-circuit disposed therein, which resets the at least one of the first latch sub-circuit 12 and the second latch sub-circuit 14 according to a received reset control signal. For example, in some embodiments, a first reset sub-circuit for resetting the first latch sub-circuit 12 may be disposed in the first latch sub-circuit 12. In some other embodiments, a second reset sub-circuit for resetting the second latch sub-circuit 12 may be disposed in the second latch sub-circuit 14. In some other embodiments, the first latch sub-circuit 12 may have the first reset sub-circuit disposed therein, and the second latch sub-circuit 14 may have the second reset sub-circuit disposed therein. This will be described in detail below with reference to FIGS. 3 to 8.

Figure 3:
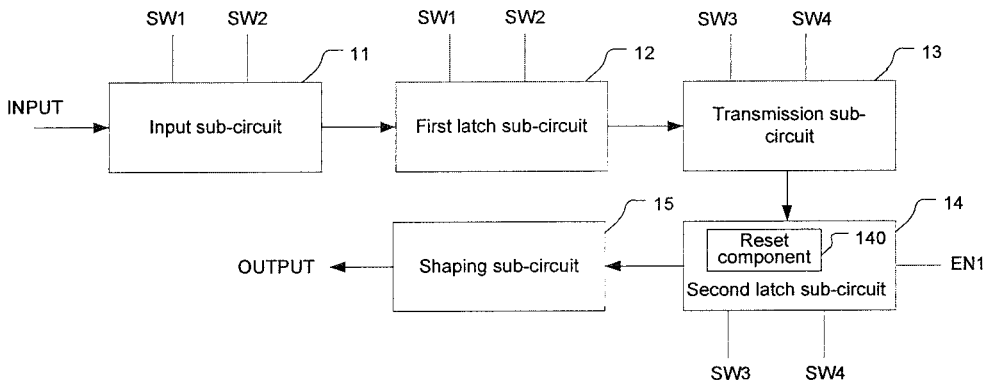
FIG. 3 is a schematic block diagram of a source driving circuit according to another embodiment of the present disclosure.

FIG. 3 is a schematic block diagram of a source driving circuit according to another embodiment of the present disclosure. The embodiment of FIG. 3 differs from the embodiment of FIG. 1 at least in that a reset sub-circuit 140 (second reset sub-circuit) is disposed in the second latch sub-circuit 14. For the sake of clarity of description, the differences will be mainly described below. As shown in FIG. 3, the reset sub-circuit 140 is disposed in the second latch sub-circuit 14. When the source driving circuit operates, if a reset control signal EN1 (second reset control signal) received by the reset sub-circuit 140 indicates a resetting operation (for example, the reset control signal EN1 is at the second level), the reset sub-circuit 140 resets the second latch sub-circuit 14 (for example, causes the second latch sub-circuit 14 to output a reset signal). In some embodiments, if the reset control signal EN1 received by the reset sub-circuit 140 indicates a normal operation (for example, the reset control signal EN1 is at the first level), the reset sub-circuit 140 acts as a portion of the loop in the second latch sub-circuit 14.

Figure 4:
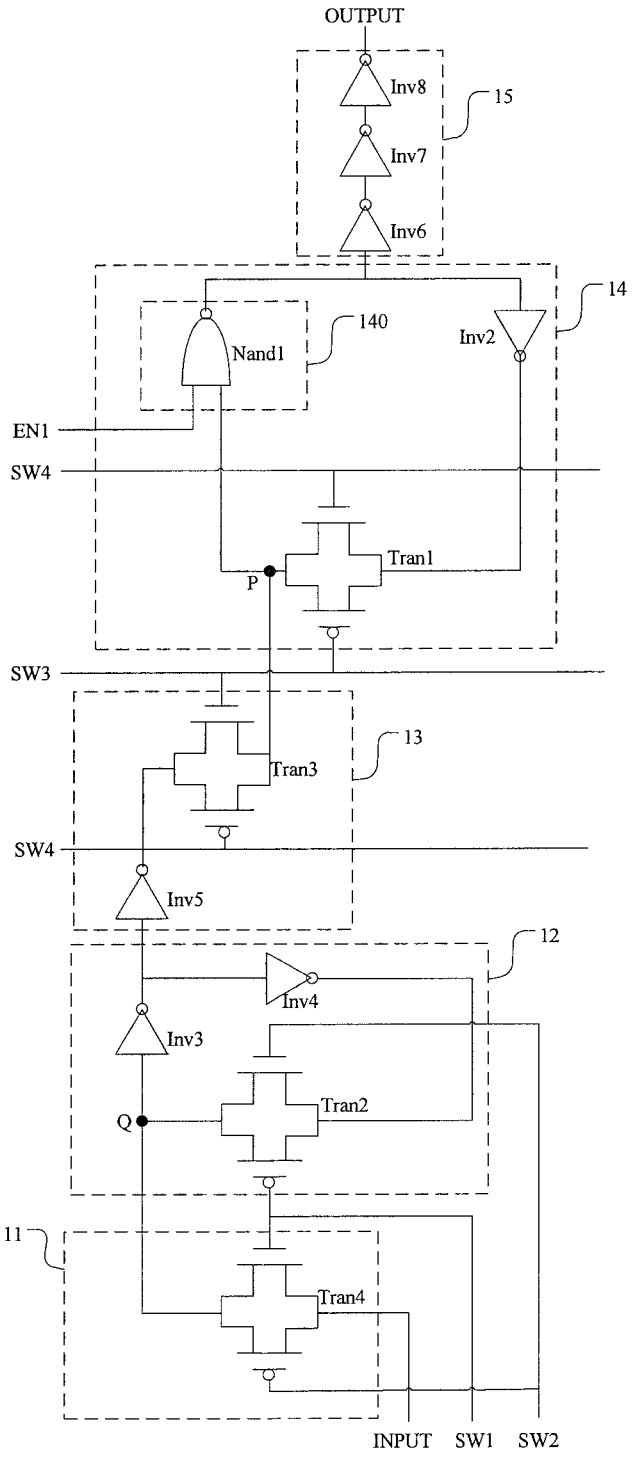
FIG. 4 is an exemplary circuit diagram of the source driving circuit of FIG. 3.

FIG. 4 is an exemplary circuit diagram of the source driving circuit of FIG. 3. As shown in FIG. 4, the second latch sub-circuit 14 comprises the transmission gate Tran1, the reset sub-circuit 140, and the inverter Inv2. The reset sub-circuit 140 and the inverter Inv2 are connected in series between the input terminal and the output terminal of the transmission gate Tran1 to form a loop. The transmission gate Tran1 is turned on or turned off according to the control signal SW3 and the control signal SW4. As shown in FIG. 4, the transmission gate Tran1 has the input terminal, the first control terminal, the second control terminal, and the output terminal, wherein the first control terminal of the transmission gate Tran1 receives the control signal SW3, the second control terminal of the transmission gate Tran1 receives the control signal SW4, and the output terminal of the transmission gate Tran1 is connected to the input terminal of the transmission gate Tran3 of the transmission sub-circuit 13 to receive the data signal from the transmission sub-circuit 13. In the example of FIG. 4, the reset sub-circuit 140 comprises an NAND gate Nand1, wherein the NAND gate Nand1 has a first input terminal configured to receive the reset control signal EN1, a second input terminal connected to the output terminal of the transmission gate Tran1, and an output terminal connected to the input terminal of the inverter Inv2. The output terminal of the inverter Inv2 is connected to the input terminal of the transmission gate Tran1. In FIG. 4, the node between the output terminal of the transmission gate Tran1 and the output terminal of the transmission gate Tran3 is denoted by P, and the second latch sub-circuit 14 receives the data signal from the transmission sub-circuit 13 at the node P. The output terminal of the NAND gate Nand1, that is, a node between the output terminal of the NAND gate Nand1 and the input terminal of the inverter Inv2, outputs the data signal as the output terminal of the second latch sub-circuit 14, for example, outputs the data signal to the shaping sub-circuit 15.

When the source driving circuit of FIG. 4 operates, for example, at any time in the periods T1 to T5 shown in FIG. 11, if the reset control signal EN1 indicates a normal operation, for example, the reset control signal EN1 is at a high level, the first input terminal of the NAND gate Nand1 is at a high level, and then the NAND gate Nand1 outputs a low level when the NAND gate Nand1 receives the data signal which is at a high level at the second input terminal thereof (i.e., the node P), and outputs a high level when the NAND gate Nand1 receives the data signal which is at a low level at the second input terminal thereof. That is, if the reset control signal EN1 is at a high level, the NAND gate Nand1 acts as an inverter, to form a loop together with the NAND gate Nand1, the transmission gate Tran1, and the inverter Inv2 when the transmission gate Tran1 is turned on, so that the data signal is latched by the second latch sub-circuit 14. On the contrary, if the reset control signal EN1 indicates a resetting operation, for example, the reset control signal EN1 is at a low level, according to characteristics of NAND gates, the NAND gate Nand1 outputs a high level regardless of whether the data signal received at the second input terminal (i.e., the node P) of the NAND gate Nand1 is at a high level or a low level. The high level output by the NAND gate Nand1 is converted into the output signal OUTPUT at a low level through three stages of inversion by the shaping sub-circuit 15. When the output signal OUTPUT at a low level is transmitted to a respective pixel on a display panel, the pixel is not used for display, to realize resetting of the display. For example, the resetting may be implemented when an active time during which the output signal OUTPUT is at a low level exceeds a preset time.

In the embodiment of the present disclosure, fast resetting of the source driving circuit may be realized to prevent residual of the data signal, which enables a display area, for example, an Active Area (AA) for display, on the display panel to be quickly discharged, thereby alleviating a residual phenomenon in the screen display.

Figure 5:
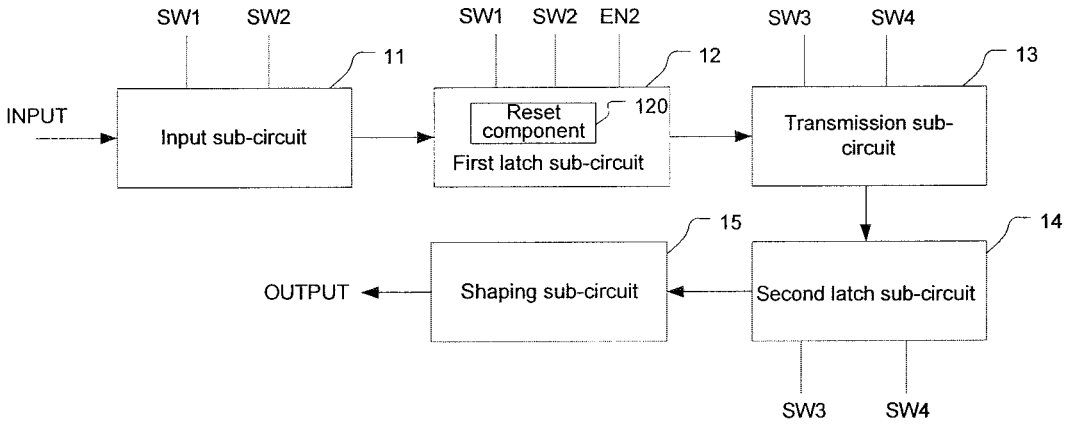
FIG. 5 is a schematic block diagram of a source driving circuit according to yet another embodiment of the present disclosure.

FIG. 5 is a schematic block diagram of a source driving circuit according to another embodiment of the present disclosure. The embodiment of FIG. 5 differs from the embodiment of FIG. 1 at least in that a reset sub-circuit 120 (first reset sub-circuit) is disposed in the first latch sub-circuit 12. For the sake of clarity of description, the differences will be mainly described below. As shown in FIG. 5, the reset sub-circuit 120 is disposed in the first latch sub-circuit 12. When the source driving circuit operates, if a reset control signal EN2 (first reset control signal) received by the reset sub-circuit 120 indicates a resetting operation (for example, the reset control signal EN2 is at the second level), the reset sub-circuit 120 resets the first latch sub-circuit 12 (for example, causes the first latch sub-circuit 12 to output a reset signal). In some embodiments, if the reset control signal EN2 received by the reset sub-circuit 120 indicates a normal operation (for example, the reset control signal EN2 is at the first level), the reset sub-circuit 120 acts as a portion of the loop in the first latch sub-circuit 12.

Figure 6:
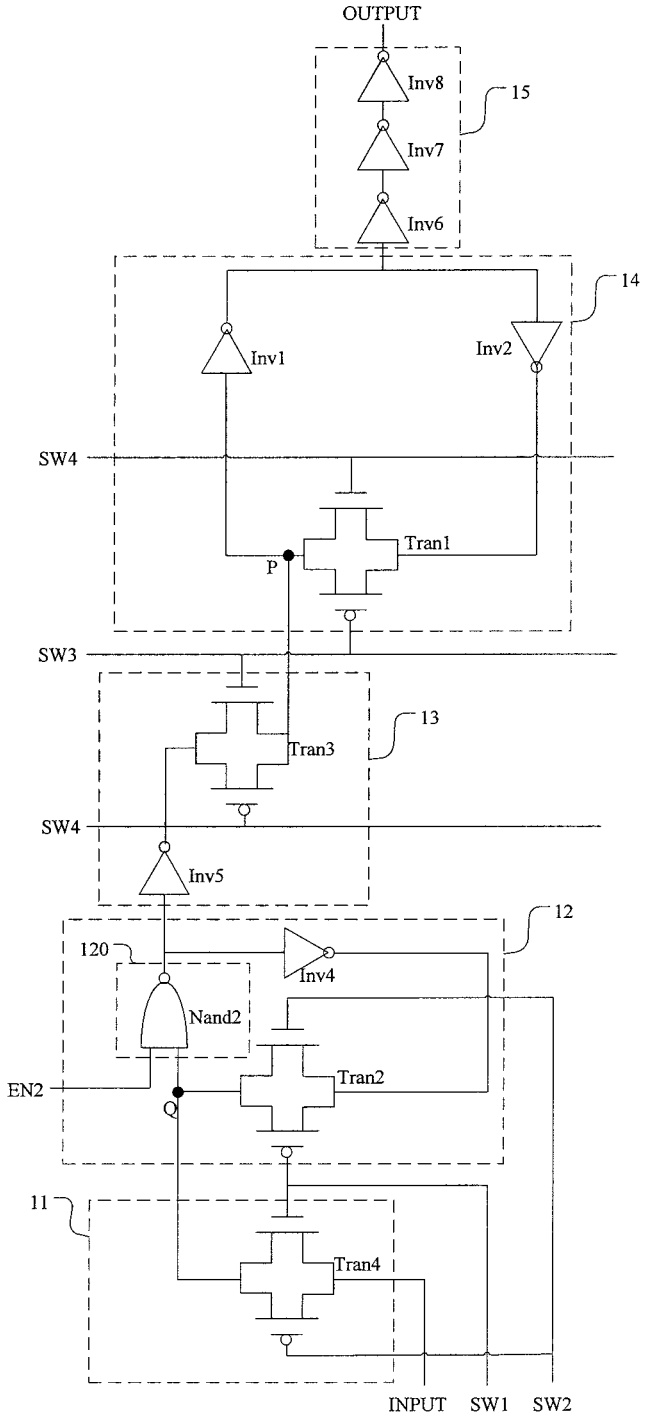
FIG. 6 is an exemplary circuit diagram of the source driving circuit of FIG. 5.

FIG. 6 is an exemplary circuit diagram of the source driving circuit of FIG. 5. As shown in FIG. 6, the first latch sub-circuit 12 may comprise the transmission gate Tran2, the reset sub-circuit 120, and the inverter Inv4. The reset sub-circuit 120 and the inverter Inv4 are connected in series between the input terminal and the output terminal of the transmission gate Tran2 to form a loop. The transmission gate Tran2 is turned on or turned off according to the control signal SW1 and the control signal SW2. As shown in FIG. 6, the transmission gate Tran2 has the input terminal, the first control terminal, the second control terminal, and the output terminal, wherein the first control terminal of the transmission gate Tran2 receives the control signal SW1, the second control terminal of the transmission gate Tran2 receives the control signal SW2, and the output terminal of the transmission gate Tran2 is connected to the output terminal of the transmission gate Tran4 in the input sub-circuit 11 to receive the data signal from the input sub-circuit 11. In the example of FIG. 6, the reset sub-circuit 120 comprises an NAND gate Nand2, wherein the NAND gate Nand2 has a first input terminal configured to receive the reset control signal EN2, a second input terminal connected to the output terminal of the transmission gate Tran2, and an output terminal connected to the input terminal of the inverter Inv4. The output terminal of the inverter Inv4 is connected to the input terminal of the transmission gate Tran2. In FIG. 6, the node between the output terminal of the transmission gate Tran2 and the output terminal of the transmission gate Tran4 is denoted by Q, and the first latch sub-circuit 12 receives the data signal from the input sub-circuit 11 at the node Q. The output terminal of the NAND gate Nand2, that is, a node between the output terminal of the NAND gate Nand2 and the input terminal of the inverter Inv4, is connected as the output terminal of the first latch sub-circuit 12 to the transmission sub-circuit 13 to provide the data signal to the transmission sub-circuit 13.

When the source driving circuit of FIG. 6 operates, for example, at any time in the periods T1 to T5 shown in FIG. 11, if the reset control signal EN2 indicates a normal operation, for example, the reset control signal EN2 is at a high level, the first input terminal of the NAND gate Nand2 is at a high level, and then the NAND gate Nand2 outputs a low level when the NAND gate Nand2 receives the data signal which is at a high level at the second input terminal thereof (i.e., the node Q), and outputs a high level when the NAND gate Nand2 receives the data signal which is at a low level at the second input terminal thereof. That is, if the reset control signal EN2 is at a high level, the NAND gate Nand2 acts as an inverter, to form a loop together with the NAND gate Nand2, the transmission gate Tran2, and the inverter Inv4 when the transmission gate Tran2 is turned on, so that the data signal is latched by the first latch sub-circuit 12. On the contrary, if the reset control signal EN2 indicates a resetting operation, for example, the reset control signal EN2 is at a low level, according to characteristics of NAND gates, the NAND gate Nand2 outputs a high level regardless of whether the data signal received at the second input terminal (i.e., the node Q) of the NAND gate Nand2 is at a high level or a low level. The high level output by the NAND gate Nand2 becomes the output signal OUTPUT at a low level through the transmission sub-circuit 13, the second latch sub-circuit 14 and the shaping sub-circuit 15. When the output signal OUTPUT at a low level is transmitted to a respective pixel on a display panel, the pixel is not used for display, to realize resetting of the display. For example, the resetting may be implemented when an active time during which the output signal OUTPUT is at a low level exceeds a preset time.

In the embodiment of the present disclosure, fast resetting of the source driving circuit may be realized to prevent residual of the data signal, which enables a display area, for example, an Active Area (AA) for display, on the display panel to be quickly discharged, thereby alleviating a residual phenomenon in the screen display.

Figure 7:
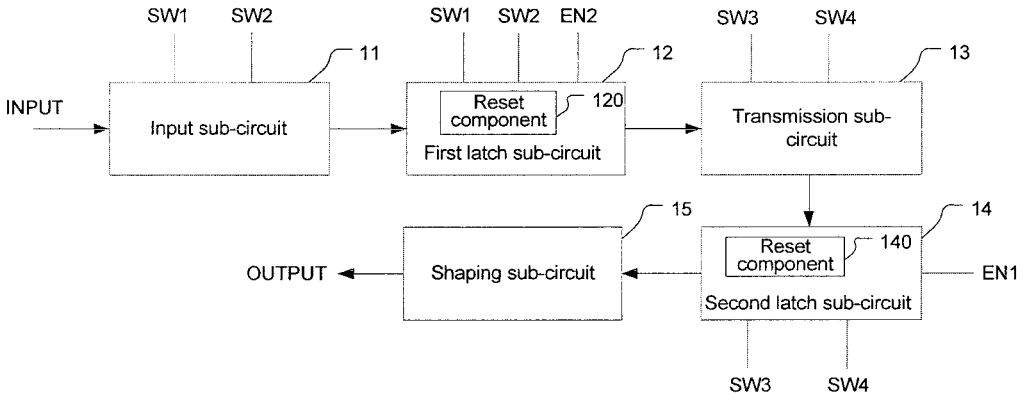
FIG. 7 is a schematic block diagram of a source driving circuit according to still another embodiment of the present disclosure.

FIG. 7 is a schematic block diagram of a source driving circuit according to another embodiment of the present disclosure. The embodiment of FIG. 7 differs from the embodiment of FIG. 1 at least in that a reset sub-circuit 120 (first reset sub-circuit) is disposed in the first latch sub-circuit 12 and a reset sub-circuit 140 (second reset sub-circuit) is disposed in the second latch sub-circuit 14. For the sake of clarity of description, the differences will be mainly described below.

As shown in FIG. 7, the first latch sub-circuit 12 has a reset sub-circuit 120 is disposed therein. When the source driving circuit operates, if a reset control signal EN2 (first reset control signal) received by the reset sub-circuit 120 indicates a resetting operation (for example, the reset control signal EN2 is at the second level), the reset sub-circuit 120 resets the first latch sub-circuit 12 (for example, causes the first latch sub-circuit 12 to output a reset signal). In some embodiments, if the reset control signal EN2 received by the reset sub-circuit 120 indicates a normal operation (for example, the reset control signal EN2 is at the first level), the reset sub-circuit 120 acts as a portion of the loop in the first latch sub-circuit 12.

The second latch sub-circuit 14 has a reset sub-circuit 140 is disposed therein. When the source driving circuit operates, if a reset control signal EN1 (second reset control signal) received by the reset sub-circuit 140 indicates a resetting operation (for example, the reset control signal EN1 is at the second level), the reset sub-circuit 140 resets the second latch sub-circuit 14 (for example, causes the second latch sub-circuit 14 to output a reset signal). In some embodiments, if the reset control signal EN1 received by the reset sub-circuit indicates a normal operation (for example, the reset control signal EN1 is at the first level), the reset sub-circuit 140 acts as a portion of the loop in the second latch sub-circuit 14.

Figure 8:
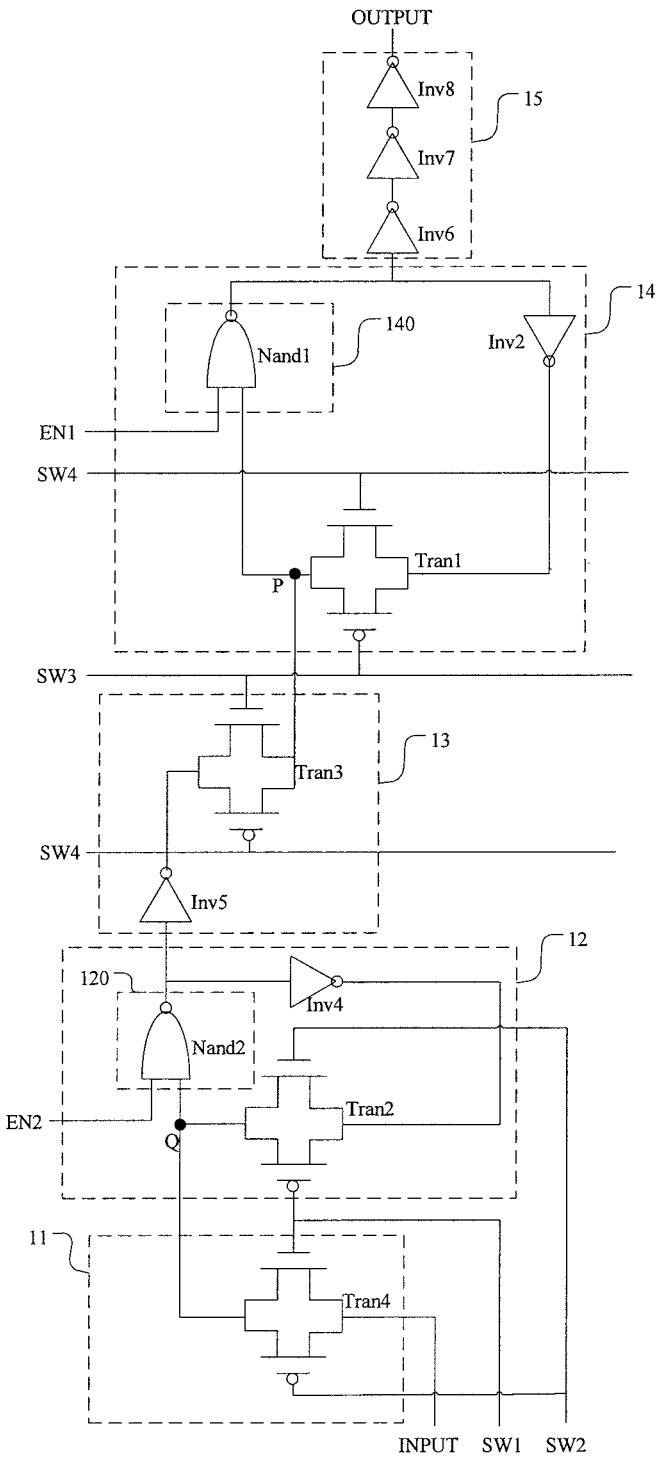
FIG. 8 is an exemplary circuit diagram of the source driving circuit of FIG. 7.

FIG. 8 is an exemplary circuit diagram of the source driving circuit of FIG. 7.

As shown in FIG. 8, the first latch sub-circuit 12 may comprise the transmission gate Tran2, the reset sub-circuit 120 (first reset sub-circuit), and the inverter Inv4. The reset sub-circuit 120 and the inverter Inv4 are connected in series between the input terminal and the output terminal of the transmission gate Tran2 to form a loop. The transmission gate Tran2 is turned on or turned off according to the control signal SW1 and the control signal SW2. As shown in FIG. 8, the transmission gate Tran2 has the input terminal, the first control terminal, the second control terminal, and the output terminal, wherein the first control terminal of the transmission gate Tran2 receives the control signal SW1, the second control terminal of the transmission gate Tran2 receives the control signal SW2, and the output terminal of the transmission gate Tran2 is connected to the output terminal of the transmission gate Tran4 in the input sub-circuit 11 to receive the data signal from the input sub-circuit 11. In the example of FIG. 8, the reset sub-circuit 120 comprises an NAND gate Nand2, wherein the NAND gate Nand2 has a first input terminal configured to receive the reset control signal EN2, a second input terminal connected to the output terminal of the transmission gate Tran2, and an output terminal connected to the input terminal of the inverter Inv4. The output terminal of the inverter Inv4 is connected to the input terminal of the transmission gate Tran2. In the present embodiment, the node between the output terminal of the transmission gate Tran2 and the output terminal of the transmission gate Tran4 is denoted by Q, and the first latch sub-circuit 12 receives the data signal from the input sub-circuit 11 at the node Q. The output terminal of the NAND gate Nand2, that is, a node between the output terminal of the NAND gate Nand2 and the input terminal of the inverter Inv4, is connected as the output terminal of the first latch sub-circuit 12 to the transmission sub-circuit 13 to provide the data signal to the transmission sub-circuit 13.

The second latch sub-circuit 14 comprises the transmission gate Tran1, the reset sub-circuit 140 (second reset sub-circuit), and the inverter Inv2. The reset sub-circuit 140 and the inverter Inv2 are connected in series between the input terminal and the output terminal of the transmission gate Tran1 to form a loop. The transmission gate Tran1 is turned on or turned off according to the control signal SW3 and the control signal SW4. As shown in FIG. 4, the transmission gate Tran1 has the input terminal, the first control terminal, the second control terminal, and the output terminal, wherein the first control terminal of the transmission gate Tran1 receives the control signal SW3, the second control terminal of the transmission gate Tran1 receives the control signal SW4, and the output terminal of the transmission gate Tran1 is connected to the input terminal of the transmission gate Tran3 of the transmission sub-circuit 13 to receive the data signal from the transmission sub-circuit 13. In the example of FIG. 4, the reset sub-circuit 140 comprises an NAND gate Nand1, wherein the NAND gate Nand1 has a first input terminal configured to receive the reset control signal EN1 (second reset control signal), a second input terminal connected to the output terminal of the transmission gate Tran1, and an output terminal connected to the input terminal of the inverter Inv2. The output terminal of the inverter Inv2 is connected to the input terminal of the transmission gate Tran1. In the present embodiment, the node between the output terminal of the transmission gate Tran1 and the output terminal of the transmission gate Tran3 is denoted by P, and the second latch sub-circuit 14 receives the data signal from the transmission sub-circuit 13 at the node P. The output terminal of the NAND gate Nand1, that is, a node between the output terminal of the NAND gate Nand1 and the input terminal of the inverter Inv2, outputs the data signal as the output terminal of the second latch sub-circuit 14, for example, outputs the data signal to the shaping sub-circuit 15.

When the source driving circuit of FIG. 8 operates, for example, at any time in the periods T1 to T5 shown in FIG. 11, a resetting function may be realized using at least one of the reset control signal EN1 and the reset control signal EN2.

As an example, if the reset control signal EN1 indicates a normal operation, for example, the reset control signal EN1 is at a high level, the first input terminal of the NAND gate Nand1 is at a high level, and then the NAND gate Nand1 outputs a low level when the NAND gate Nand1 receives the data signal which is at a high level at the second input terminal thereof (i.e., the node P), and outputs a high level when the NAND gate Nand1 receives the data signal which is at a low level at the second input terminal thereof. That is, if the reset control signal EN1 is at a high level, the NAND gate Nand1 acts as an inverter, to form a loop together with the NAND gate Nand1, the transmission gate Tran1, and the inverter Inv2 when the transmission gate Tran1 is turned on, so that the data signal is latched by the second latch sub-circuit 14. On the contrary, if the reset control signal EN1 indicates a resetting operation, for example, the reset control signal EN1 is at a low level, according to characteristics of NAND gates, the NAND gate Nand1 outputs a high level regardless of whether the data signal received at the second input terminal (i.e., the node P) of the NAND gate Nand1 is at a high level or a low level. The high level output by the NAND gate Nand1 is converted into the output signal OUTPUT at a low level through three stages of inversion by the shaping sub-circuit 15. When the output signal OUTPUT at a low level is transmitted to a respective pixel on a display panel, the pixel is not used for display, to realize resetting of the display. For example, the resetting may be implemented when an active time during which the output signal OUTPUT is at a low level exceeds a preset time.

As an example, if the reset control signal EN2 indicates a normal operation, for example, the reset control signal EN2 is at a high level, the first input terminal of the NAND gate Nand2 is at a high level, and then the NAND gate Nand2 outputs a low level when the NAND gate Nand2 receives the data signal which is at a high level at the second input terminal thereof (i.e., the node Q), and outputs a high level when the NAND gate Nand2 receives the data signal which is at a low level at the second input terminal thereof. That is, if the reset control signal EN2 is at a high level, the NAND gate Nand2 acts as an inverter, to form a loop together with the NAND gate Nand2, the transmission gate Tran2, and the inverter Inv4 when the transmission gate Tran2 is turned on, so that the data signal is latched by the first latch sub-circuit 12. On the contrary, if the reset control signal EN2 indicates a resetting operation, for example, the reset control signal EN2 is at a low level, according to characteristics of NAND gates, the NAND gate Nand2 outputs a high level regardless of whether the data signal received at the second input terminal (i.e., the node Q) of the NAND gate Nand2 is at a high level or a low level. The high level output by the NAND gate Nand2 becomes the output signal OUTPUT at a low level after passing through the transmission sub-circuit 13, the second latch sub-circuit 14 and the shaping sub-circuit 15. When the output signal OUTPUT at a low level is transmitted to a respective pixel on a display panel, the pixel is not used for display, to realize resetting of the display. For example, the resetting may be implemented when an active time during which the output signal OUTPUT is at a low level exceeds a preset time.

In the embodiment of the present disclosure, fast resetting of the source driving circuit may be realized to prevent residual of the data signal, which enables a display area, for example, an Active Area (AA) for display, on the display panel to be quickly discharged, thereby alleviating a residual phenomenon in the screen display.

Figure 9:
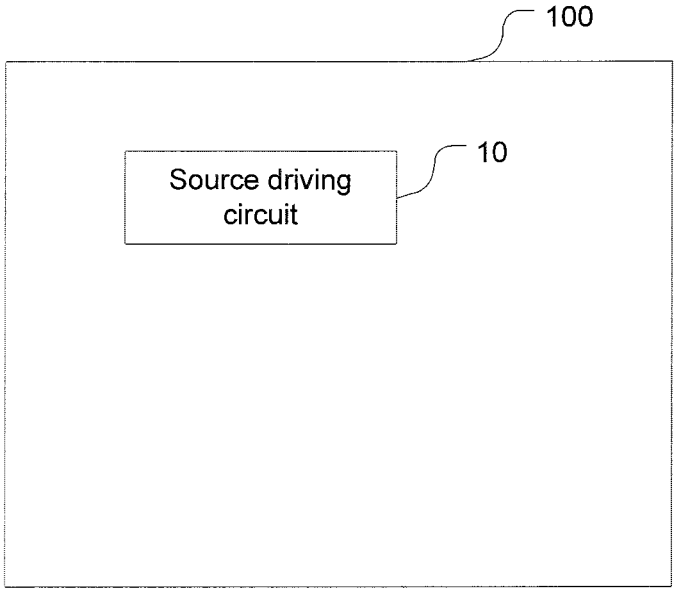
FIG. 9 is a schematic block diagram of a display apparatus according to an embodiment of the present disclosure.

FIG. 9 is a schematic block diagram of a display apparatus according to an embodiment of the present disclosure. As shown in FIG. 9, the display apparatus 100 comprises a source driving circuit 10 which may be implemented by the source driving circuit described in any of the embodiments described above. It should be understood by those skilled in the art that the display apparatus 100 may further comprise a display panel, a timing control circuit, and a gate driving circuit (not shown), wherein the timing control circuit controls the source driving circuit 10 to apply a source driving signal to the display panel and control the gate driving circuit to apply a gate driving signal to the display panel, so as to control the display panel to perform screen display. It should be understood by those skilled in the art that the source driving circuit 10 may comprise shift registers, digital to analog converters, output buffers, etc. in addition to the components described above, which will not be described in detail here for the sake of brevity. Types of display apparatuses according to the embodiments of the present disclosure comprise, but not limited to, Liquid Crystal Displays (LCDs), and Organic Light-Emitting Diode (OLED) displays. In the present embodiment, the display apparatus may be a display apparatus using a Memory in Pixel (MIP) technology. A main principle of the MIP technology is to dispose a memory in the display panel to reduce power consumption of the display apparatus by reducing a refresh frequency.

In the embodiments of the present disclosure, a second one of two stages of latching in the source driving circuit is designed to comprise the second latch sub-circuit 14 and the transmission sub-circuit 13, the second latch sub-circuit 14 is turned off when the transmission sub-circuit 13 is turned on, and the second latch sub-circuit 14 is turned on when the transmission sub-circuit 13 is turned off, so that the second latch sub-circuit 14 is in a turn-off state when the transmission sub-circuit 13 transmits the data signal to the second latch sub-circuit 14, and thereby there is no loop formed, which avoids the race hazard, thereby improving the stability of the data transmission. In the embodiment of the present disclosure, fast resetting of the source driving circuit may be realized to prevent residual of the data signal, which enables a display area, for example, an Active Area (AA) for display, on the display panel to be quickly discharged, thereby alleviating a residual phenomenon in the screen display.

Figure 10:
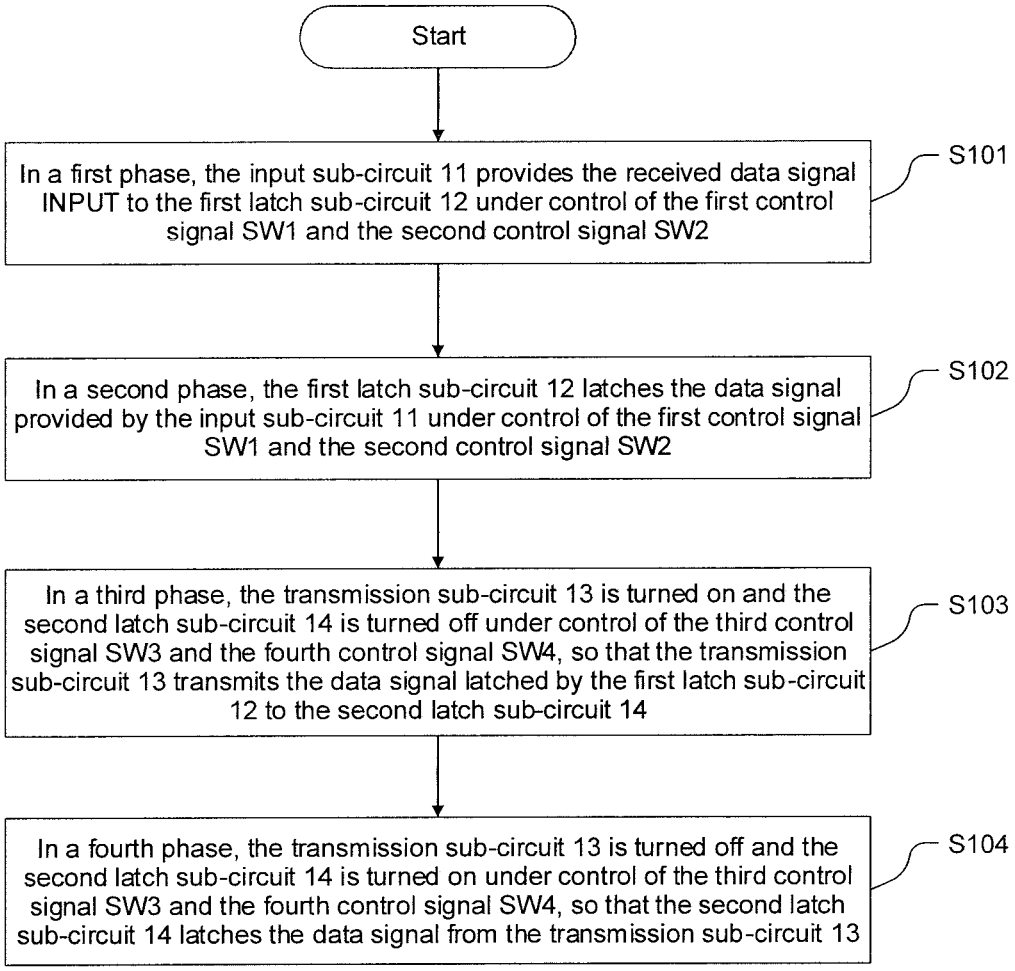
FIG. 10 is a flowchart of a driving method according to an embodiment of the present disclosure.

FIG. 10 is a flowchart of a driving method according to an embodiment of the present disclosure. In the present embodiment, the driving method may be applied to the source driving circuit described in any of the embodiments described above.

In step S101, in a first phase, the input sub-circuit 11 provides the received data signal INPUT to the first latch sub-circuit 12 under control of the first control signal SW1 and the second control signal SW2.

In step S102, in a second phase, the first latch sub-circuit 12 latches the data signal provided by the input sub-circuit 11 under control of the first control signal SW1 and the second control signal SW2.

In step S103, in a third phase, the transmission sub-circuit 13 is turned on and the second latch sub-circuit 14 is turned off under control of the third control signal SW3 and the fourth control signal SW4, so that the transmission sub-circuit 13 transmits the data signal latched by the first latch sub-circuit 12 to the second latch sub-circuit 14.

In step S104, in a fourth phase, the transmission sub-circuit 13 is turned off and the second latch sub-circuit 14 is turned on under control of the third control signal SW3 and the fourth control signal SW4, so that the second latch sub-circuit 14 latches the data signal from the transmission sub-circuit 13.

The driving method according to the embodiment of the present disclosure may further comprise a resetting step. For example, in step S105 (not shown), at least one of the first latch sub-circuit 12 and the second latch sub-circuit 14 is reset under control of a reset control signal (for example, at least one of the reset control signals EN1 and EN2 described above). This step may be performed at any time in the first to fourth phases. In other words, at any time during the execution of the driving method according to the embodiment of the present disclosure, a resetting operation may be performed as long as the reset control signal indicating the resetting operation is received.

According to the driving method of the embodiment of the present disclosure, the second latch sub-circuit is turned off during the transmission of the data signal from the first latch sub-circuit to the second latch sub-circuit, and a data transmission path from the first latch sub-circuit to the second latch sub-circuit is disconnected when the second latch sub-circuit latches the data signal, which avoids the race hazard, thereby improving the stability of the data transmission. In the driving method according to the embodiment of the present disclosure, fast resetting of the source driving circuit may further be realized to prevent residual of the data signal, which enables a display area, for example, an Active Area (AA) for display, on the display panel to be quickly discharged, thereby alleviating a residual phenomenon in the screen display.

In addition, in the embodiments described above, the transmission gates Tran1, Tran2, Tran3, and Tran4 each comprises an N-channel Metal Oxide Semiconductor (NMOS) transistor and a P-channel Metal Oxide Semiconductor (PMOS) transistor (as shown in FIG. 2, FIG. 4, FIG. 6, and FIG. 8), and correspondingly, the first level may be a high level and the second level may be a low level (as shown in FIG. 11). However, the embodiments of the present disclosure are not limited thereto, the NMOS transistor and the PMOS transistor are used interchangeably, and the first level and the second level may also be a low level and a high level respectively.

The above description is merely specific implementations of the present disclosure, but the protection scope of the present disclosure is not limited thereto. Changes or substitutions which may easily be reached by those skilled in the art within the technical scope of the present disclosure should be covered within the protection scope of the present disclosure. Therefore, the protection scope of the present disclosure should be determined by the protection scope of the claims.

We claim:

1. A source driving circuit, comprising:

an input sub-circuit configured to receive a data signal, a first control signal, and a second control signal, and provide the received data signal to an output terminal of the input sub-circuit according to the first control signal and the second control signal;

a first latch sub-circuit connected to the output terminal of the input sub-circuit, the first latch sub-circuit is configured to receive the first control signal and the second control signal, latch the data signal provided from the output terminal of the input sub-circuit according to the first control signal and the second control signal, and provide the latched data signal to an output terminal of the first latch sub-circuit;

a transmission sub-circuit connected to the output terminal of the first latch sub-circuit, the transmission sub-circuit is configured to receive a third control signal and a fourth control signal, and transmit the latched data signal from the output terminal of the first latch sub-circuit to an output terminal of the transmission sub-circuit according to the third control signal and the fourth control signal; and a second latch sub-circuit connected to the output terminal of the transmission sub-circuit, the second latch sub-circuit is configured to receive the third control signal and the fourth control signal, and latch the data signal from the output terminal of the transmission sub-circuit according to the third control signal and the fourth control signal, wherein, the first latch sub-circuit has a first reset sub-circuit disposed therein, wherein the first reset sub-circuit is configured to receive a first reset control signal and reset the first latch sub-circuit according to the first reset control signal; and/or the second latch sub-circuit has a second reset sub-circuit disposed therein, wherein the second reset sub-circuit is configured to receive a second reset control signal and reset the second latch sub-circuit according to the second reset control signal.

2. The source driving circuit according to claim 1, wherein the transmission sub-circuit comprises:

a fifth inverter having an input terminal and an output terminal, wherein the input terminal of the fifth inverter is configured to receive the data signal from the first latch sub-circuit; and a third transmission gate having an input terminal connected to the output terminal of the fifth inverter, a first control terminal configured to receive the fourth control signal, a second control terminal configured to receive the third control signal, and an output terminal connected to the second latch sub-circuit, wherein the third transmission gate is configured to be turned on or turned off according to the third control signal and the fourth control signal.

3. The source driving circuit according to claim 1, wherein the second latch sub-circuit has the second reset sub-circuit disposed therein, wherein the second latch sub-circuit comprises:

a first transmission gate having an input terminal, a first control terminal, a second control terminal, and an output terminal, and configured to be turned on or turned off according to the third control signal and the fourth control signal, wherein the first control terminal of the first transmission gate is configured to receive the third control signal, the second control terminal of the first transmission gate is configured to receive the fourth control signal, and the output terminal of the first transmission gate is configured to receive the data signal from the transmission sub-circuit;

the second reset sub-circuit comprising a first NAND gate having a first input terminal configured to receive the second reset control signal, a second input terminal connected to the output terminal of the first transmission gate, and an output terminal acting as the output terminal of the second latch sub-circuit; and a second inverter having an input terminal and an output terminal, wherein the input terminal of the second inverter is connected to the output terminal of the first NAND gate, and the output terminal of the second inverter is connected to the input terminal of the first transmission gate.

4. The source driving circuit according to claim 1, wherein the first latch sub-circuit has the first reset sub-circuit disposed therein, wherein the first latch sub-circuit comprises:

a second transmission gate having an input terminal, a first control terminal, a second control terminal, and an output terminal, and configured to be turned on or turned off according to the first control signal and the second control signal, wherein the first control terminal of the second transmission gate is configured to receive the first control signal, the second control terminal of the second transmission gate is configured to receive the second control signal, and the output terminal of the second transmission gate is configured to receive the data signal from the input sub-circuit;

the first reset sub-circuit comprising a second NAND gate having a first input terminal configured to receive the first reset control signal, a second input terminal connected to the output terminal of the second transmission gate, and an output terminal acting as the output terminal of the first latch sub-circuit; and a fourth inverter having an input terminal and an output terminal, wherein the input terminal of the fourth inverter is connected to the output terminal of the second NAND gate, and the output terminal of the fourth inverter is connected to the input terminal of the second transmission gate.

5. The source driving circuit according to claim 1, wherein the first latch sub-circuit has the first reset sub-circuit disposed therein and the second latch sub-circuit has the second reset sub-circuit disposed therein, wherein the first latch sub-circuit comprises:

a second transmission gate having an input terminal, a first control terminal, a second control terminal, and an output terminal, and configured to be turned on or turned off according to the first control signal and the second control signal, wherein the first control terminal of the second transmission gate is configured to receive the first control signal, the second control terminal of the second transmission gate is configured to receive the second control signal, and the output terminal of the second transmission gate is configured to receive the data signal from the input sub-circuit;

the first reset sub-circuit comprising a second NAND gate having a first input terminal configured to receive the first reset control signal, a second input terminal connected to the output terminal of the second transmission gate, and an output terminal acting as the output terminal of the first latch sub-circuit; and a fourth inverter having an input terminal and an output terminal, wherein the input terminal of the fourth inverter is connected to the output terminal of the second NAND gate, and the output terminal of the fourth inverter is connected to the input terminal of the second transmission gate, and the second latch sub-circuit comprises:

a first transmission gate having an input terminal, a first control terminal, a second control terminal, and an output terminal, and configured to be turned on or turned off according to the third control signal and the fourth control signal, wherein the first control terminal of the first transmission gate is configured to receive the third control signal, the second control terminal of the first transmission gate is configured to receive the fourth control signal, and the output terminal of the first transmission gate is configured to receive the data signal from the transmission sub-circuit;

the second reset sub-circuit comprising a first NAND gate having a first input terminal configured to receive the second reset control signal, a second input terminal connected to the output terminal of the first transmission gate, and an output terminal acting as the output terminal of the second latch sub-circuit; and a second inverter having an input terminal and an output terminal, wherein the input terminal of the second inverter is connected to the output terminal of the first NAND gate, and the output terminal of the second inverter is connected to the input terminal of the first transmission gate.

6. The source driving circuit according to claim 1, wherein the input sub-circuit comprises:

a fourth transmission gate having an input terminal configured to receive the data signal, a first control terminal configured to receive the second control signal, a second control terminal configured to receive the first control signal, and an output terminal configured to output the received data signal, wherein the fourth transmission gate is configured to be turned on or turned off according to the first control signal and the second control signal.

7. The source driving circuit according to claim 1, further comprising a shaping sub-circuit having a sixth inverter, a seventh inverter, and an eighth inverter, wherein the sixth inverter has an input terminal configured to receive the data signal from the second latch sub-circuit, and an output terminal connected to an input terminal of the seventh inverter, the seventh inverter has an output terminal connected to an input terminal of the eighth inverter, and the eighth inverter has an output terminal acting as an output terminal of the source driving circuit.

8. A display apparatus, comprising the source driving circuit according to claim 1.

9. A method for driving a source driving circuit, the source driving circuit, comprising:

an input sub-circuit configured to receive a data signal, a first control signal, and a second control signal, and provide the received data signal to an output terminal of the input sub-circuit according to the first control signal and the second control signal;

a first latch sub-circuit connected to the output terminal of the input sub-circuit, the first latch sub-circuit is configured to receive the first control signal and the second control signal, latch the data signal provided from the output terminal of the input sub-circuit according to the first control signal and the second control signal, and provide the latched data signal to an output terminal of the first latch sub-circuit;

a transmission sub-circuit connected to the output terminal of the first latch sub-circuit, the transmission sub-circuit is configured to receive a third control signal and a fourth control signal, and transmit the latched data signal from the output terminal of the first latch sub-circuit to an output terminal of the transmission sub-circuit according to the third control signal and the fourth control signal; and a second latch sub-circuit connected to the output terminal of the transmission sub-circuit, the second latch sub-circuit is configured to receive the third control signal and the fourth control signal, and latch the data signal from the output terminal of the transmission sub-circuit according to the third control signal and the fourth control signal, wherein, the first latch sub-circuit has a first reset sub-circuit disposed therein, wherein the first reset sub-circuit is configured to receive a first reset control signal and reset the first latch sub-circuit according to the first reset control signal; and/or the second latch sub-circuit has a second reset sub-circuit disposed therein, wherein the second reset sub-circuit is configured to receive a second reset control signal and reset the second latch sub-circuit according to the second reset control signal, the method comprising:

in the first phase, providing, by the input sub-circuit, the received data signal to the first latch sub-circuit under control of the first control signal and the second control signal;

in a second phase, latching, by the first latch sub-circuit, the data signal provided by the input sub-circuit under control of the first control signal and the second control signal;

in a third phase, turning on the transmission sub-circuit and turning off the second latch sub-circuit under control of the third control signal and the fourth control signal, so that the transmission sub-circuit transmits the data signal latched by the first latch sub-circuit to the second latch sub-circuit; and in a fourth phase, turning off the transmission sub-circuit and turning on the second latch sub-circuit under control of the third control signal and the fourth control signal, so that the second latch sub-circuit latches the data signal from the transmission sub-circuit.

10. The method according to claim 9, further comprising:

resetting at least one of the first latch sub-circuit and the second latch sub-circuit under control of the reset control signal.

11. The method according to claim 9, further comprising:

shaping the data signal latched by the second latch sub-circuit and outputting the shaped data signal.

* * * * *